US006423979B1

(12) United States Patent
Kohda

(10) Patent No.: US 6,423,979 B1
(45) Date of Patent: Jul. 23, 2002

(54) TRANSFER OF STIMULABLE PHOSPHOR SHEET

(75) Inventor: Katsuhiro Kohda, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/484,697

(22) Filed: Jan. 18, 2000

(30) Foreign Application Priority Data

Jan. 18, 1999 (JP) ..... 11-009493

(51) Int. Cl.[7] ..... B65H 7/00
(52) U.S. Cl. ..... 250/589; 250/590
(58) Field of Search ..... 250/589, 590

(56) References Cited

U.S. PATENT DOCUMENTS 5,081,357 A * 1/1992 Agano ..... 250/327.2

FOREIGN PATENT DOCUMENTS

| | | | |
|---|---|---|---|
| EP | 0 114 978 | * 8/1984 | ..... 250/589 |
| JP | 11-314802 | * 11/1999 | ..... 250/589 |

* cited by examiner

*Primary Examiner*—Huy Mai
(74) *Attorney, Agent, or Firm*—Sughrue Mion, PLLC

(57) ABSTRACT

A method for transferring a stimulable phosphor sheet by holding and driving the phosphor sheet by a set of rollers which are placed on both edge sides of the phosphor sheet, at least one of the rollers being rotated by a driving force provided by a driving means, is advantageously employed in a radiation image reading step composed of sequentially applying stimulating rays onto the phosphor sheet to excite the phosphor sheet whereby releasing radiation energy from the radiation image as light emission and collecting the light emission from both surface sides of the phosphor sheet.

10 Claims, 2 Drawing Sheets

FIG. 3 - (1)
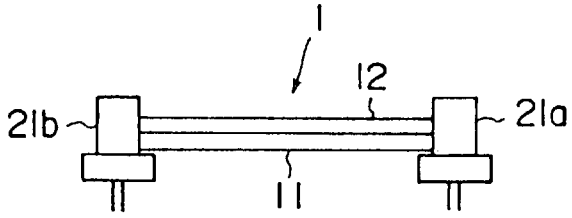
FIG. 3 - (2)
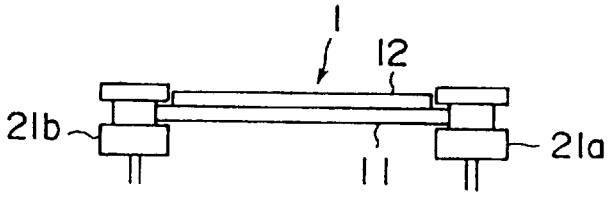
FIG. 4
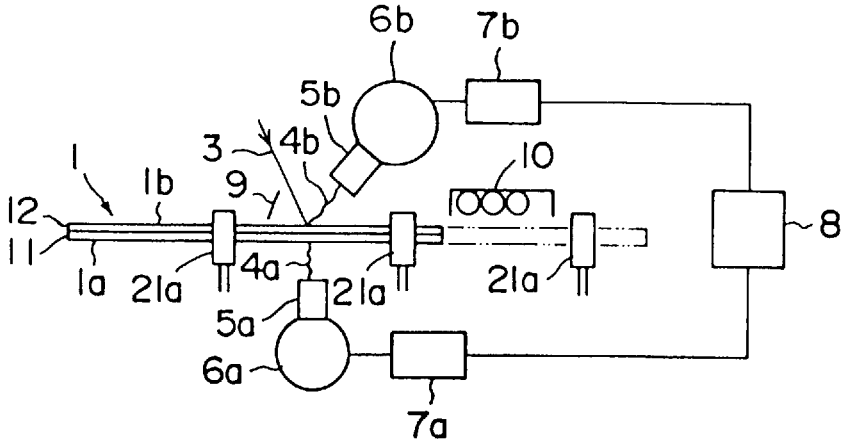

TRANSFER OF STIMULABLE PHOSPHOR SHEET

FIELD OF THE INVENTION

The present invention relates to a method for transferring a stimulable phosphor sheet which is favorably employed in a double-side image reading procedure of a radiation image recording and reproducing system.

BACKGROUND OF THE INVENTION

As a method replacing a conventional radiography, a radiation image recording and reproducing method utilizing a stimulable phosphor was proposed and has been practically employed. The method employs a stimulable phosphor sheet (i.e., radiation image storage panel) comprising a stimulable phosphor, and comprises the steps of causing the stimulable phosphor of the phosphor sheet to absorb radiation energy having passed through an object or having radiated from an object; sequentially exciting the stimulable phosphor with an electromagnetic wave such as visible light or infrared rays (hereinafter referred to as "stimulating rays") to release the radiation energy stored in the phosphor as light emission (i.e., stimulated emission); photoelectrically detecting the emitted light to obtain electric signals; and reproducing the radiation image of the object as a visible image from the electric signals. The phosphor sheet thus treated is then subjected to a step for erasing a radiation image remaining therein, and then stored for the next recording and reproducing procedure. Thus, the stimulable phosphor sheet can be repeatedly employed.

The stimulable phosphor sheet has a basic structure comprising a support and a stimulable phosphor layer provided thereon. If the phosphor layer is self-supporting, the support may be omitted. On the free surface (surface not facing the support) of the phosphor layer, a transparent protective film is generally placed to keep the phosphor layer from chemical deterioration or physical damage.

The radiation image recorded in the stimulable phosphor sheet is generally read by the steps of applying stimulating rays onto the top surface side (phosphor layer side) of the phosphor sheet, collecting light (i.e., stimulated emission) emitted by the phosphor particles by means of a light-collecting means from the same side, and photoelectrically converting the light into digital signals of image. A system for reading the image from one side of the phosphor sheet in this manner is referred to as "single-side reading system". However, there is a case that the light emitted by the phosphor particles should be collected from both sides (i.e., front and back surface sides) of the phosphor sheet. For instance, there is a case that the emitted light should be collected as much as possible. There is also a case that the radiation image recorded in the phosphor layer varies along the depth of the phosphor layer, and that the variation should be detected. A system for reading the image from both sides of the stimulable phosphor sheet is referred to as "double-side reading system".

A radiation image storage panel employed in the double-side reading system, as well as a panel employed in the single-side reading system, is desired to be as sensitive as possible and to provide a radiation image of high quality (high sharpness, high graininess, etc.). The double-side reading system is described in Japanese Patent Provisional Publication No. 55-87970.

In the apparatus for the double-side reading system illustrated in the Japanese publication, the stimulable phosphor sheet is conveyed by means of a pair of nip rollers which drive the phosphor sheet to horizontally move by driving force directly applied to both surfaces of the phosphor sheet. The simulating rays such as a laser beam are applied onto the top surface of the phosphor sheet, and the stimulated emission radiated from the inside of the phosphor sheet is detected from both of the top and back surface sides. The stimulable phosphor sheet thus treated is further conveyed by means of the nip rollers which apply driving force onto both surfaces of the phosphor sheet, and successively exposed to erasing light radiated from the erasing light sources for performing the erasing procedure.

As is described above, both surfaces of the stimulable phosphor sheet are moved in contact with a pair of rollers which in combination give driving force to the phosphor sheet. Therefore, the phosphor sheet is apt to get scratches and/or stains on its surfaces after employment in the repeated radiation image recording and reproducing procedures. The presence of scratches and stains on the surfaces of the stimulable phosphor sheet gives adverse effects such as lowering of an image quality to a radiation image reproduced from the phosphor sheet.

SUMMARY OF THE INVENTION

It is an object of the present invention to provide a method for transferring a stimulable phosphor sheet in a radiation image recording and reproducing method.

It is another object of the invention to provide a method for transferring a stimulable phosphor sheet which is favorably employable during the double-side radiation image reading procedure.

The present invention resides in a method for transferring a stimulable phosphor sheet which comprises holding and driving the stimulable phosphor sheet by a set of rollers which are placed on both edge sides of the phosphor sheet, at least one of the rollers being rotated by a driving force provided by a driving means.

The invention also resides in a method for transferring a stimulable phosphor sheet containing a radiation image therein during a radiation image reading step comprising sequentially applying stimulating rays onto the phosphor sheet to excite the stimulable phosphor sheet whereby releasing radiation energy from the radiation image as light emission and collecting the light emission from both surface sides of the phosphor sheet, which comprises holding and driving the stimulable phosphor sheet by a set of rollers which are placed on both edge sides of the phosphor sheet, at least one of the rollers being rotated by a driving force provided by a driving means.

BRIEF DESCRIPTION OF DRAWINGS

FIGS. 3-(1) and 3-(2) illustrate variations of rollers which are employable in the transferring system according to the invention.

FIG. 4 schematically illustrates an apparatus for performing a double-side radiation image reading procedure according to the invention.

DETAILED DESCRIPTION OF THE INVENTION

The present invention is further described by referring to the attached drawings.

Figure 1:
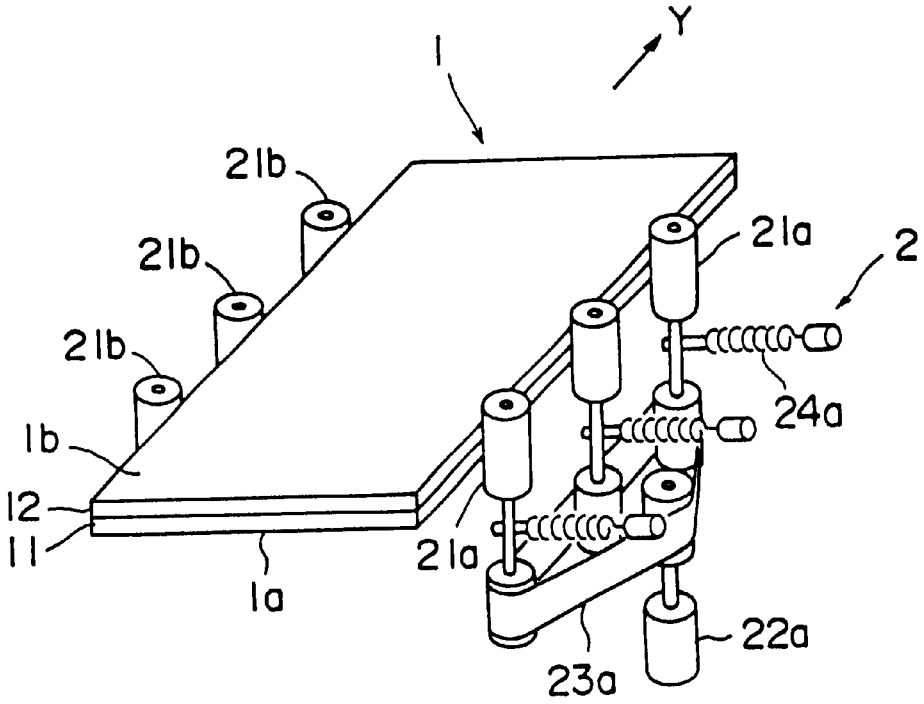
FIG. 1 schematically illustrates a system for transferring a stimulable phosphor sheet according to the invention.
Figure 2:
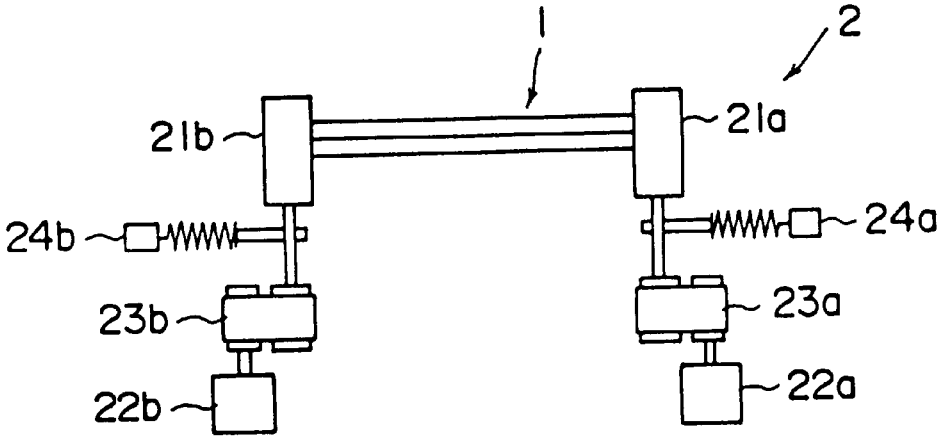
FIG. 2 is a front view of the transferring system of FIG. 1.

FIG. 1 schematically illustrates a system for transferring a stimulable phosphor sheet according to the invention, and FIG. 2 is a front view of the transferring system.

A stimulable phosphor sheet 1 comprises a transparent support 11 and a stimulable phosphor layer 12 arranged on the support 11. The back surface side of the phosphor sheet 1 which corresponds to the free surface side of the support 11 is denoted by 1*a*, and the top surface side of the phosphor sheet which corresponds to the free surface side of the phosphor layer 12 is denoted by 1*b*.

The transferring means 2 comprises a pair of rollers 21*a*, 21*b* which are arranged in contact with the both edge sides of the phosphor sheet 1 and which give driving force to the phosphor sheet 1 for advancing. The rollers 21*a*, 21*b* are rotated by actuating motors 22*a*, 22*b*, respectively, using belts 23*a*, 23*b*. To the rollers 21*a*, 21*b* are attached pressing means 24*a*, 24*b* for giving force or pressure to the rollers so as to hold the phosphor sheet 1 between a pair of rollers 21*a*, 21*b*.

The stimulable phosphor sheet 1 introduced into the transfer system of FIG. 1 are hold by means of a pair of rollers 21*a*, 21*b* under pressure applied to the rollers by the pressing means 24*a*, 24*b*. The phosphor sheet 1 is driven to move horizontally in the direction of Y by the driving force supplied by the rollers 21*a*, 21*b* which is transmitted from the motors 22*a*, 22*b*.

FIG. 3 illustrates front views of a pair of rollers of different transfer systems. Each of the rollers 21*a*, 21*b* of FIG. 3-(1) has a flange at its bottom end to hold the phosphor sheet 1 thereon more stably. Each of the rollers 21*a*, 21*b* of FIG. 3-(2) has a flange not only at its bottom end, but also at its top end. The phosphor sheet 1 employed in combination with the transferring rollers 21*a*, 21*b* of FIG. 3 preferably comprises a transparent support 11 and a stimulable phosphor layer 12 placed thereon under the condition that both side edges of the phosphor layer 12 are retracted from the corresponding side edges of the support 11. The stimulable phosphor sheet 1 of this structure is advantageous, because the phosphor layer 12 is kept apart from the rollers 21*a*, 21*b* and hence is more free from receiving mechanical shock from the rollers.

The flange of FIG. 3-(1) as well as FIG. 3-(2) preferably has a diameter larger than the diameter of the core portion of the roller by 2 mm to 3 cm. If the flange is provided to the rollers as is illustrated in FIG. 3-(1) and FIG. 3-(2), the pressing means for giving force to the rollers may be omitted.

In FIG. 1 to FIG. 3, three pairs of rollers are shown. However, the number of rollers employed in the transfer system of the invention may be varied according to the transfer system. Moreover, the transfer can be made not only horizontally but also vertically.

FIG. 4 schematically illustrates an apparatus for performing a double-side radiation image reading procedure.

In the apparatus of FIG. 4, the stimulable phosphor sheet 1 is conveyed by means of several pairs of rollers 21*a*, 21*b* in the direction denoted by Y. The stimulating rays 3 such as a laser beam are applied onto the top surface of the phosphor sheet 1, and the stimulated emission radiated from the inside of the phosphor sheet 1 is detected from both of the top and back surface sides. The stimulated emission 4*a* emitted from the back surface is collected with a light-collecting guide 5*a* provided below, and photoelectrically converted into a series of electric signals by means of an opto-electric conversion device (e.g., photomultiplier tube) 6*a* attached to the light-collecting guide 5*a*. The signals thus obtained from the back surface of the stimulable phosphor sheet 1 are amplified in an amplifier 7*a*, and then transferred to a data processor 8. On the other hand, the stimulated emission 4*b* emitted from the top surface is, directly or via a mirror 9, collected by a light-collecting guide 5*b* provided above, and photoelectrically converted into a series of electric signals by means of an opto-electric conversion device (e.g., photomultiplier tube) 6*b* attached to the light-collecting guide 5*b*. The signals thus obtained from the front surface side of the phosphor sheet are amplified in an amplifier 7*b*, and then transferred to the data processor 8. In the data processor 8, the signals transferred from the amplifiers 7*a* and 7*b* are combined and subjected to predetermined operation processes (e.g., addition, subtraction) according to the characteristics of the aimed radiation image, so as to obtain the desired radiation image signals.

The stimulable phosphor sheet 1 thus treated is then conveyed in the direction of Y by means of the rollers 21*a* and 21*b*, and successively exposed to erasing light radiated from the erasing light sources 10 for performing the erasing procedure. By the erasing procedure, a radiation energy remaining in the phosphor layer of the phosphor sheet 1 after reading procedure is released to remove so that the latent image of the remaining radiation energy may not give undesirable effects to the next recording procedure.

A variety of stimulable phosphor sheets are already known. Variations of stimulable phosphor sheets reside in their sizes, compositions, structures, etc. For instance, the stimulable phosphor sheet can have a transparent protective layer on the phosphor layer. The stimulable phosphor sheet may have an auxiliary layer such as a subbing layer, a colored layer or a backing layer. Otherwise, the stimulable phosphor sheet can have a honey comb structure. Any of the known stimulable phosphor sheets can be employed in the transfer system of the invention.

What is claimed is:

1. A method for transferring a stimulable phosphor sheet which comprises holding and driving the stimulable phosphor sheet by a set of rollers which are placed on both edge sides of the phosphor sheet, at least one of the rollers being rotated by a driving force provided by a driving means.

2. The method of claim 1, wherein the stimulable phosphor sheet is hold horizontally and driven to move in a horizontal direction.

3. The method of claim 1, wherein the stimulable phosphor sheet is hold under pressure applied by the rollers to the side edges of the phosphor sheet.

4. The method of claim 1, wherein the rollers have a flange on their bottom sides and the stimulable phosphor sheet is hold by the flanges of the rollers.

5. The method of claim 4, wherein the stimulable phosphor sheet comprises a transparent support sheet and a stimulable phosphor layer placed on the support sheet under the condition that both side edges of the phosphor layer are retracted from the corresponding side edges of the support sheet.

6. A method for transferring a stimulable phosphor sheet containing a radiation image therein during a radiation image reading step comprising sequentially applying stimulating rays onto the phosphor sheet to excite the stimulable phosphor sheet whereby releasing radiation energy from the radiation image as light emission and collecting the light emission from both surface sides of the phosphor sheet, which comprises holding and driving the stimulable phosphor sheet by a set of rollers which are placed on both edge sides of the phosphor sheet, at least one of the rollers being rotated by a driving force provided by a driving means.

7. The method of claim 6, wherein the stimulable phosphor sheet is hold horizontally and driven to move in a horizontal direction.

8. The method of claim 6, wherein the stimulable phosphor sheet is hold under pressure applied by the rollers to the side edges of the phosphor sheet.

9. The method of claim 6, wherein the rollers have a flange on their bottom sides and the stimulable phosphor sheet is hold by the flanges of the rollers.

10. The method of claim 9, wherein the stimulable phosphor sheet comprises a transparent support sheet and a stimulable phosphor layer placed on the support sheet under the condition that both side edges of the phosphor layer are retracted from the corresponding side edges of the support sheet.

* * * * *